US005090936A

United States Patent [19]

Satoh et al.

[11] Patent Number: 5,090,936

[45] Date of Patent: Feb. 25, 1992

[54] MOVABLE DECORATION

[75] Inventors: Yasuta Satoh, Nagareyama; Shigeru Nakane, Narashino; Shinya Saitoh, Tokyo; Isamu Kataoka, Ichikawa, all of Japan

[73] Assignee: Takara Co., Ltd., Tokyo, Japan

[21] Appl. No.: 485,611

[22] Filed: Feb. 26, 1990

Related U.S. Application Data

[62] Division of Ser. No. 308,684, Feb. 9, 1989, Pat. No. 4,903,424.

[51] Int. Cl.[5] ..... A63H 30/00

[52] U.S. Cl. ..... 446/175; 40/411; 40/414; 272/8 N; 446/338

[58] Field of Search ..... 40/414, 411, 415, 416, 40/417, 418, 421, 423, 427, 412, 614, 455, 457; 446/303, 338, 175, 297, 390; 272/8 N

[56] References Cited

U.S. PATENT DOCUMENTS

| | | | |
|---|---|---|---|
| 1,001,395 | 8/1911 | Herbst . | |
| 2,922,253 | 1/1960 | Carter | 40/415 |
| 3,119,201 | 1/1964 | Brown et al. | 446/175 |
| 3,662,374 | 5/1972 | Harrison, III et al. . | |
| 3,685,200 | 8/1972 | Nell . | |
| 3,898,438 | 8/1975 | Nater et al. . | |
| 3,973,840 | 8/1976 | Jacobs et al. . | |
| 4,169,335 | 10/1979 | Betancourt . | |
| 4,180,932 | 1/1980 | Millard . | |
| 4,221,927 | 9/1980 | Dankman et al. . | |
| 4,267,551 | 5/1981 | Dankman et al. . | |
| 4,272,915 | 6/1981 | Noble . | |
| 4,344,243 | 8/1982 | Reszka . | |
| 4,389,811 | 1/1983 | Iwaya et al. . | |
| 4,521,205 | 6/1985 | Spector . | |
| 4,637,007 | 1/1987 | Sakurai . | |
| 4,654,659 | 3/1987 | Kubo . | |
| 4,676,764 | 6/1987 | Yeu . | |
| 4,696,653 | 9/1987 | McKeefery . | |
| 4,775,351 | 10/1988 | Provenzano Jr. | 446/175 |
| 4,775,352 | 10/1988 | Curran et al. . | |

FOREIGN PATENT DOCUMENTS

| | | | |
|---|---|---|---|
| 497495 | 12/1950 | Belgium | 446/303 |
| 7115379 | 11/1971 | Fed. Rep. of Germany . | |
| 3003499A1 | 8/1981 | Fed. Rep. of Germany . | |
| 3930543 | 10/1964 | Japan . | |
| 58-118783 | 7/1983 | Japan . | |
| 58-168391 | 11/1983 | Japan . | |
| 60-175079 | 9/1985 | Japan . | |
| 6217271 | 5/1987 | Japan . | |
| 170010 | 9/1922 | United Kingdom | 446/303 |
| 334373 | 9/1930 | United Kingdom . | |
| 666207 | 2/1952 | United Kingdom . | |
| 701036 | 12/1953 | United Kingdom . | |
| 774379 | 5/1957 | United Kingdom . | |
| 1576679 | 10/1980 | United Kingdom . | |
| 2154890A | 9/1985 | United Kingdom . | |
| 8614111 | 6/1986 | United Kingdom . | |
| 2174011A | 10/1986 | United Kingdom . | |
| 2186204A | 8/1987 | United Kingdom . | |
| 2193652A | 2/1988 | United Kingdom . | |

OTHER PUBLICATIONS

Collection of the Fabrication of Transistor Circuits by Radio World Magazine Co., Aug. 1987, pp. 280–282.

*Primary Examiner*—James R. Brittain
*Assistant Examiner*—J. Hakomaki
*Attorney, Agent, or Firm*—Price, Gess & Ubell

[57] ABSTRACT

A movable decoration capable of being moved to exhibit unexpected motion or variation in configuration while maintaining a conventional ornamental effect in a stationary state, resulting in a viewer taking much interest and exhibiting lots of imaginative power. The movable decoration includes a power supply, to which a sensor switch is connected. Also, the decoration includes a motor connected through the sensor switch to the power supply, a drive mechanism connected to the motor so as to be actuated thereby, and a core in the form of a wire operatively connected to the drive mechanism so as to be rotated depending on actuation of the drive mechanism. On the core is loosely fitted a hollow element such as a artificial plant, a doll or the like so that it may be meanderingly moved depending on and separate from rotation of the core.

13 Claims, 18 Drawing Sheets

MOVABLE DECORATION

This is a divisional application of Ser. No. 308,684, filed Feb. 9, 1989 for a MOVABLE DECORATION, now U.S. Pat. No. 4,903,424.

BACKGROUND OF THE INVENTION

1. Field of the Invention

This invention relates to a movable decoration, and more particularly to a movable decoration such as a movable artificial flower, a movable ornament, a movable knickknack or the like which is not only placed in a living space so as to serve as an decorative interior but driven or moved by means of a drive unit incorporated therein.

2. Description of the Prior Art

Conventionally, an artificial flower or the like is generally used in a manner to be stationarily placed in a living space for use as a decorative interior.

However, such a conventional stationary ornament soon loses its popularity with the lapse of time.

In view of the above, it is recently attempted to add any additional unique value to such a conventional stationary interior to give a viewer unexpected interest and surprise. Unfortunately, such attempt results in failure.

Accordingly, it would be highly desirable to develop a decoration which is capable of being moved to exhibit unexpected variation in configuration and/or appearance while maintaining a conventional ornamental effect in its stationary state.

SUMMARY OF THE INVENTION

Generally speaking, in accordance with the present invention, a movable decoration is provided. The movable decoration includes a power supply, to which a sensor is connected. The sensor may be constructed so as to detect sound of a predetermined level or more. Alternatively, it may be constructed to detect a phenomenon such as light, infrared light or the like other than sound. The movable decoration also includes a motor connected through the sensor to the power supply, a drive mechanism connected to the motor so as to be actuated thereby, and a driven element operatively connected to the drive mechanism.

In a preferred embodiment of the present invention, the driven element comprises a core. The core may be formed of a flexible and shape-retaining metal material.

In a preferred embodiment of the present invention, the power supply, sensor, motor and drive mechanism constitute a drive unit.

In a preferred embodiment of the present invention, the core is at least partially bent so that it may generally take a meandering shape.

In a preferred embodiment of the present invention, the drive mechanism is constructed for rotating the core. Alternatively, it may be constructed for reciprocating the core.

In a preferred embodiment of the present invention, a cushioning member is arranged so as to surround an outer periphery of the drive unit.

In a preferred embodiment of the present invention, the core is loosely fitted in a hollow element formed of a flexible and/or deformable material. The hollow element may be formed in imitation of an artificial flower or doll so as to constitute a decoration body.

The drive mechanism may be arranged in an upper portion of the hollow element.

Accordingly, it is an object of the present invention to provide a movable decoration which is capable of causing a viewer to take interest and exhibit imaginative power due to its unique motion.

It is another object of the present invention to provide a movable decoration which is moved to vary its configuration and appearance while exhibiting a normal ornamental effect in its stationary state, to thereby give a viewer unexpected interest and surprise.

It is a further object of the present invention to provide a movable decoration which is capable of accomplishing complicated motion.

It is still another object of the present invention to provide a movable decoration which is capable of permitting replacement of its movable section to be readily carried out.

It is yet another object of the present invention to provide a movable decoration which is capable of permitting a vessel for the decoration and its design to be selected over a wide range, as desired.

It is still a further object of the present invention to provide a movable decoration which is capable of effectively preventing its malfunction.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings; wherein:

FIGS. 18A and 18B show an example of use of the movable decoration shown in FIG. 17, in which FIG. 18A is a vertical sectional view of the movable decoration of FIG. 17 having a hollow element loosely fitted on a core and FIG. 18B is a perspective view showing an artificial plant;

DETAILED DESCRIPTION OF THE PREFERRED EMBODIMENT

Now, a movable decoration according to the present invention will be described hereinafter with reference to the accompanying drawings.

Figure 1:
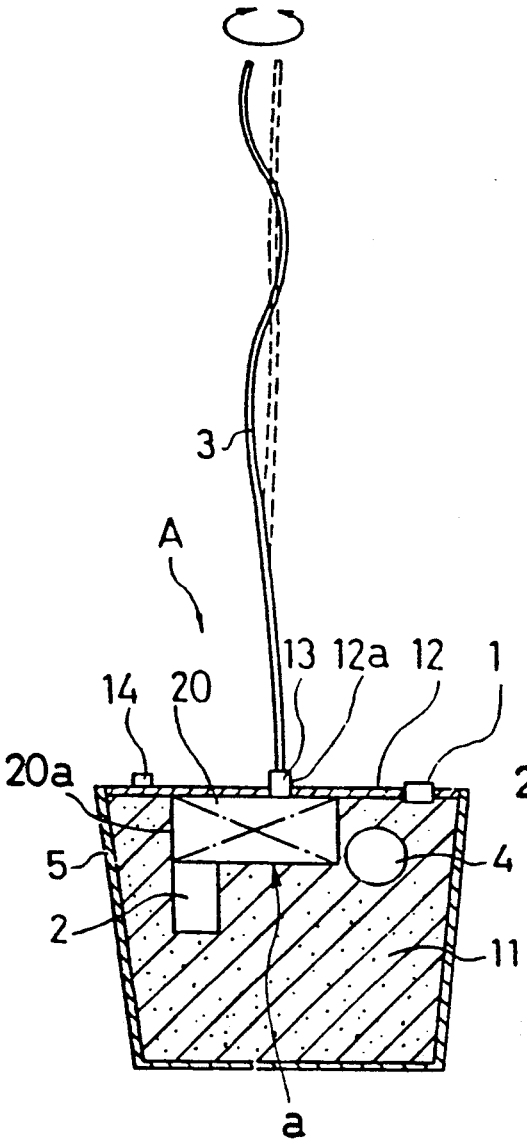
FIG. 1 is a vertical sectional view showing an embodiment of a movable decoration according to the present invention.

FIG. 1 shows an embodiment of a movable decoration according to the present invention, wherein a movable decoration is generally designated by reference character A. The movable decoration A of the illustrated embodiment generally includes a drive unit indicated at reference character a and a driven element 3 moved or driven by the drive unit a. In the illustrated embodiment, the drive unit a includes a sensor switch 1, a drive source 2, a drive mechanism 20 actuated by the driving source 2 and a power supply 4. The sensor switch 1 may comprise a sound sensor which is adapted to operate when detecting sound of a predetermined level or more and the drive source 2 may comprise a motor. However, a sensor which is adapted to detect a phenomenon such as light, infrared light, heat, vibration or the like other than sound may be used as the sensor switch 1. The drive mechanism 20 is adapted to rotate the driven element 3 and is received in a casing 20*a*. The power supply 4 may comprise cell means. Electrical connection of the drive unit a will be described below. The so-constructed drive unit a is received in a vessel 5 which, in the embodiment, is formed into an inverted frust-conical shape.

The driven element 3, in the illustrated embodiment, serves as a core and takes the form of a wire which is arranged so as to upwardly extend from drive unit a and formed of a metal material. The driven element or core 3 is operatively connected to the drive mechanism 20 in a manner to be rotatedly moved or driven by the mechanism 20 with rotation of the motor 2. The core 3 may be straight or bent at at least a part thereof so that it may generally take a meandering shape. Also, the core 3 may be made of a deformable or bendable material. Alternatively, it may be made of a manually undeformable material. Also, it may be made of a deformable and shape-retaining material. In the illustrated embodiment, the core 3 is rotated while varying its configuration, when it is driven.

The drive unit a is surrounded with a cushioning or elastic member 11 formed of a flexible and expandable material such as, for example, a sponge and received in the vessel 5. It is merely required that the cushioning member 11 is arranged to cover an outer periphery of the drive unit a.

The vessel 5 is covered at a top thereof with a lid member 12 which is put on the cushioning member 11, so that a large part of the drive unit may be closedly kept in the vessel 5. The lid member 12 is formed at a central portion thereof with a through-hole 12*a* through which a mounting sleeve 13 of the drive mechanism 20 is fittedly inserted so as to upwardly extend from the mechanism 20 therethrough. The driven element or core 3 is securely fitted at a lower end thereof on the sleeve 13. Also, on the lid member 12 is arranged the sensor switch 1 together with a main switch 14.

Figure 3:
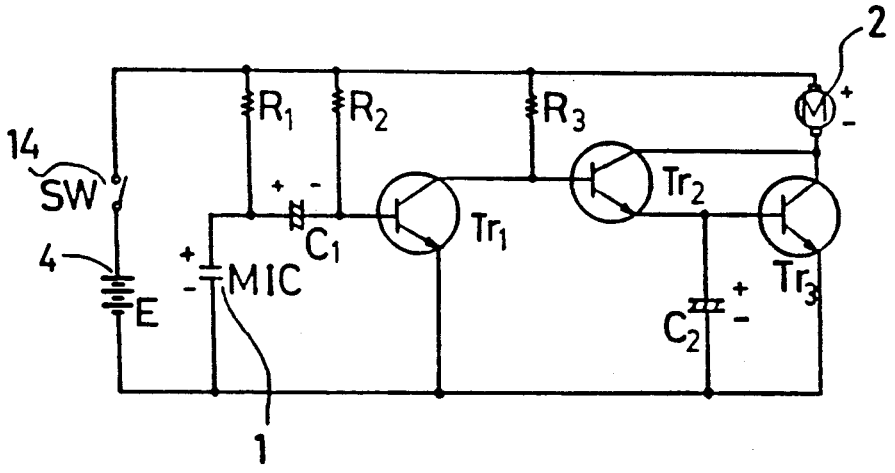
FIG. 3 is a circuit diagram showing an electrical circuit incorporated in the movable decoration shown in each of FIGS. 1 and 2.

The above-described parts constituting the drive unit a are electrically connected to one another in such a manner as shown in a circuit diagram of FIG. 3. The power supply 4 is connected between the main switch 14 and the drive source or motor 2 and the sensor switch 1 is connected between the main switch 14 and the motor 2, so that when the main switch 14 is closed and the sensor switch 1 detects sound of a predetermined level or more, the motor 2 is actuated through the power supply 4 for a predetermined period of time. Such a circuit arrangement itself is obvious to those skilled in the art.

Alternatively, the circuit for the drive unit may be constructed in a manner to permit the motor 2 to alternately carry out its actuation and stop when the sensor intermittently or continuously detects subsequent sound.

Figure 2:
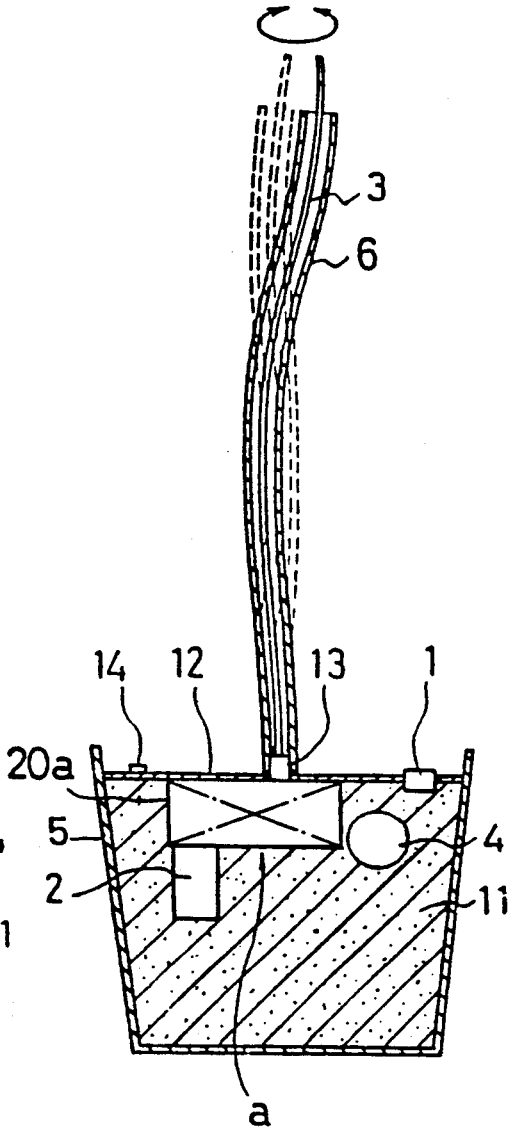
FIG. 2 is a vertical sectional view showing a modification of the movable decoration shown in FIG. 1.

In the illustrated embodiment, as shown in FIG. 2, a hollow element 6 formed of a flexible and/or deformable material such as vinyl, rubber or the like may be loosely fitted on the core 3 over a substantially overall length of the core 3 in a manner to permit the core to be freely moved in the hollow element 6. In the embodiment, the hollow element 6 comprises a tubular member. The tubular member 6 may be arranged so as to extend to the lid member 12 through the mounting sleeve 13 of the drive mechanism 20 and attached to the member 12 releasably or fixedly. Such construction permits the tubular member 6 to carry out meandering motion or movement depending on rotation of the core 3 but without being rotated, with the core 3 when the sensor switch 1 detects sound, resulting in the movable decoration exhibiting unexpected unique motion.

Figure 4:
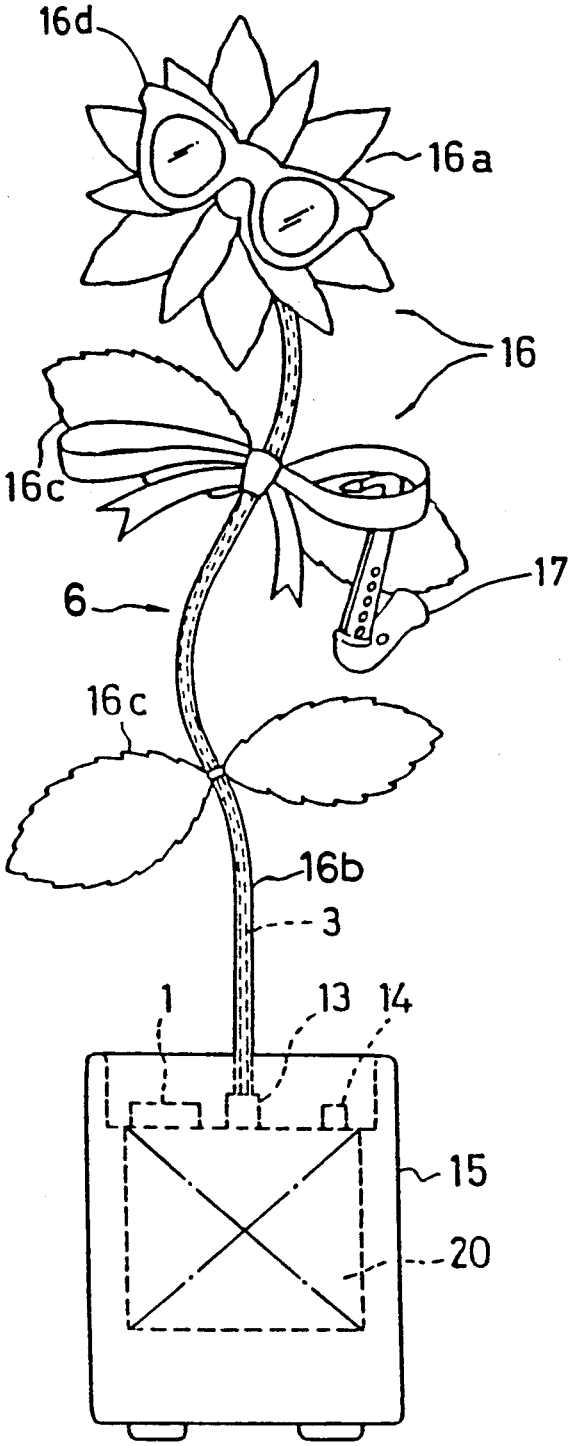
FIG. 4 is a front elevation view showing an example of use of the movable decoration shown in FIG. 1 in which it is in the form of an artificial potted plant.

FIG. 4 shows an example of use of the movable decoration of the illustrated embodiment, wherein the movable decoration is used for an artificial potted plant for decoration. For this purpose, the drive mechanism 20 is received in a vessel 15 formed into a shape like a flowerpot and the driven element or core 3 is somewhat meanderingly bent and is provided thereon with the hollow element 6 in the form of a decorative element or artificial flower 16. The decorative element or artificial flower 16 comprises a stalk 16*b*, a flower body 16*a* and leaves 16*c* integrally mounted on the stalk 16*b*. The flower body 16*a* can support simulated sunglasses 16*d*, and the leaves 16*c* can support a simulated musical instrument 17. In the example, only the stalk 16*b* may be formed into a hollow shape. The flower 16 may be integrally formed of a flexible synthetic material. The stalk 16*b* is loosely fitted on the core 3 and securely fitted at a lower end thereof on the mounting sleeve 13, so that the core 3 may be freely moved or rotated in the flower 16 and the flower 16 may be moved depending on and separate from rotation of the core 3.

In the example of FIG. 4 constructed as described above, when the main switch 14 is turned on and the sensor switch 1 detects sound of a predetermined level or more, the motor 2 is actuated. This results in the core 3 being rotated in the deformable tubular member 6 acting as the decorative element 16.

Figure 5:
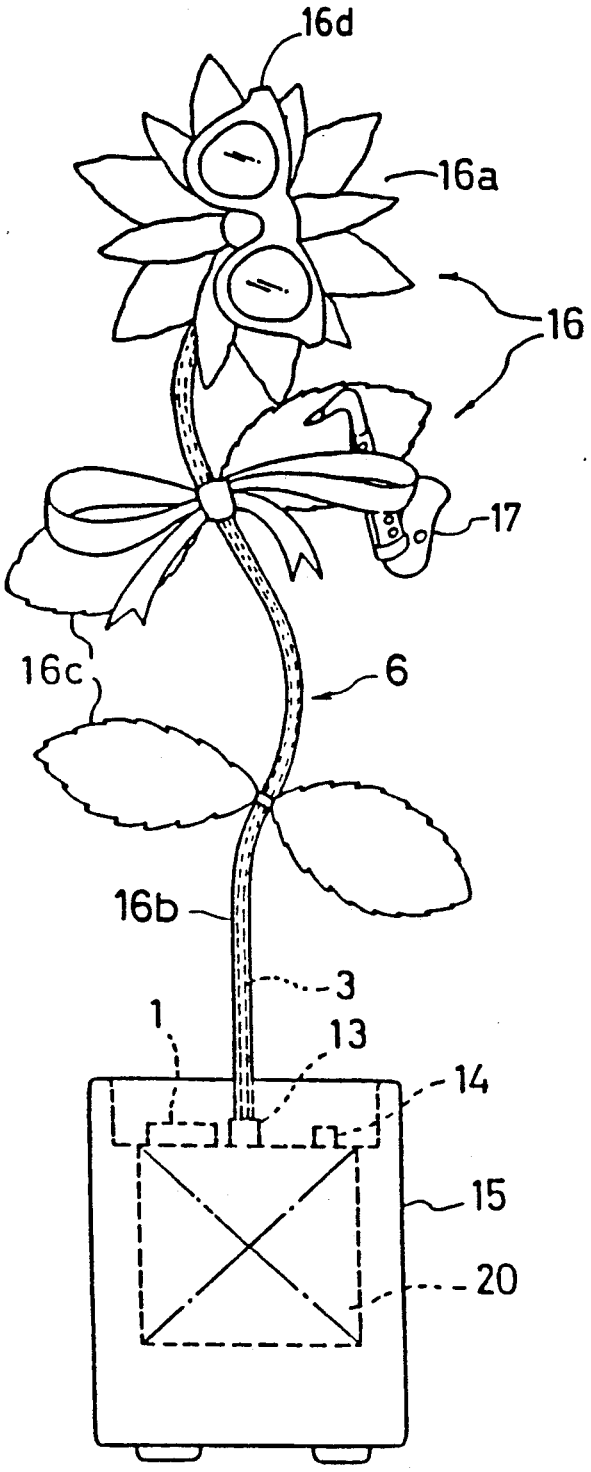
FIG. 5 is a front elevation view showing the artificial potted plant of FIG. 4 after variation of its configuration.
Figure 6:
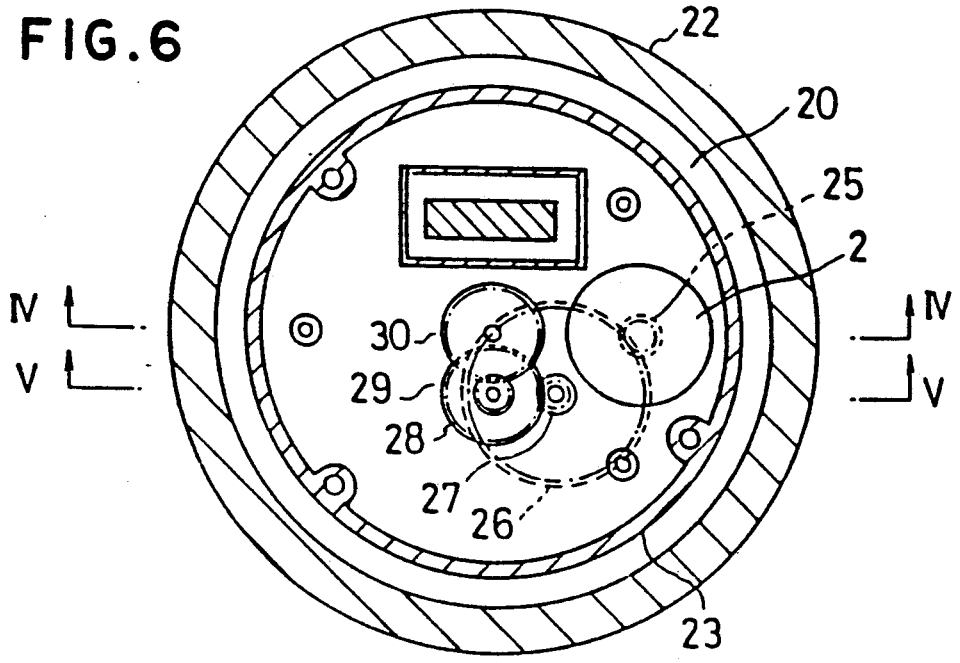
FIG. 6 is a cross sectional view taken along line I—I of FIG. 7, which shows a drive unit.

When the meanderingly bent core 3 is rotated as described above, the stalk 16*b* is meanderingly moved depending on and separate from rotation of the core 3, so that the flower 16 is varied in configuration as shown in FIGS. 4 and 5, resulting in exhibiting unexpected interest.

Also, the drive unit a is surrounded with the annular ring cushioning member 11, therefore, it may be snugly received in the vessel 15 irrespective of its size and configuration. Thus, the drive unit a is readily applied to various vessels, so that applications of the movable decoration may be extensively enlarged.

The cushioning member 11 charged in the vessel 15 generally exhibits a sound absorbing effect, so that it may absorb sound or noise generated from the motor 2 and drive mechanism 20 to prevent the sensor switch 1 from reacting on the sound and noise. Thus, malfunction of the movable decoration is effectively prevented.

In the above-described example, the vessel 15 for receiving the drive unit a therein is in the form of a flowerpot. However, it is not limited to such a specific vessel. For example, it may take the form of a basket, a vase or the like. Also, the decorative element is not limited to a flower. It may be a doll or the like. Further, the sensor switch may be adapted to turn on the drive circuit for the motor for a short period of time. Alternatively, it may actuate the motor every time when it detects sound, heat or the like. The drive mechanism 20 is not limited to that for rotating the driven element 3. It may be constructed for reciprocating it.

The drive mechanism 20 for rotating the driven element 3 may be constructed in such a manner as shown in FIGS. 6 to 16.

Figure 7:
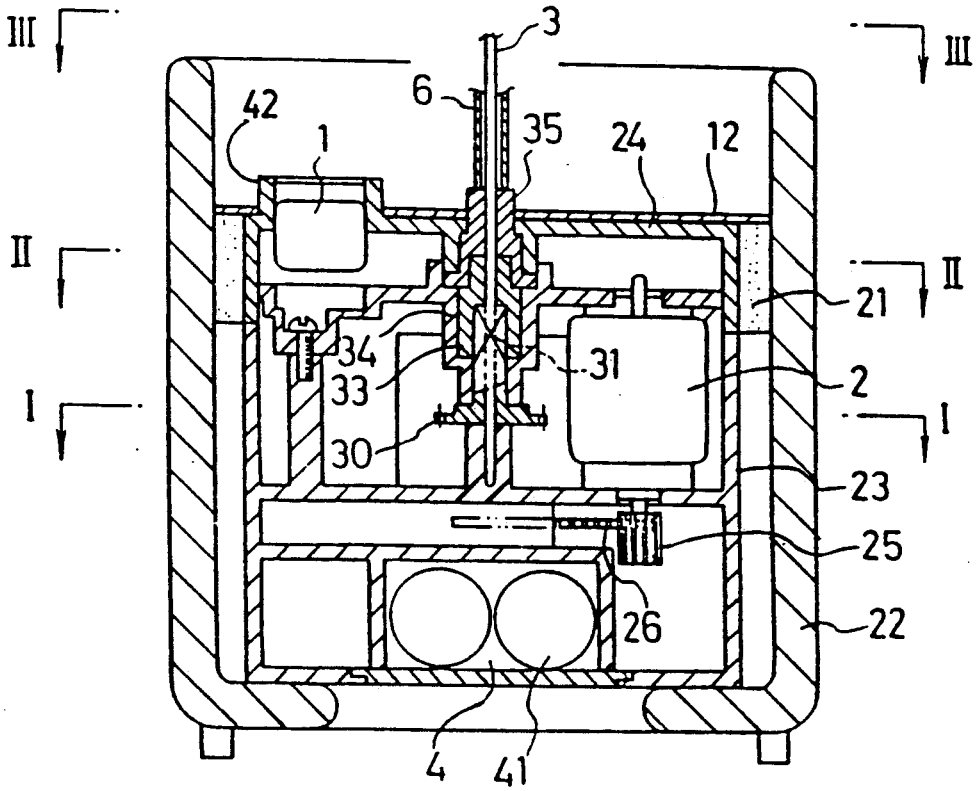
FIG. 7 is a vertical sectional view taken along line IV—IV of FIG. 6.
Figure 8:
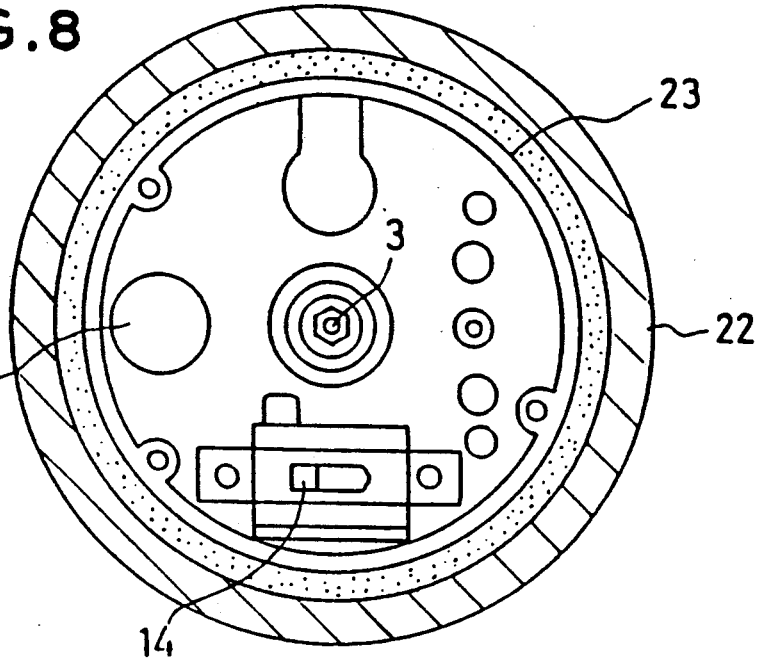
FIG. 8 is a cross sectional view taken along line II—II of FIG. 7.
Figure 9:
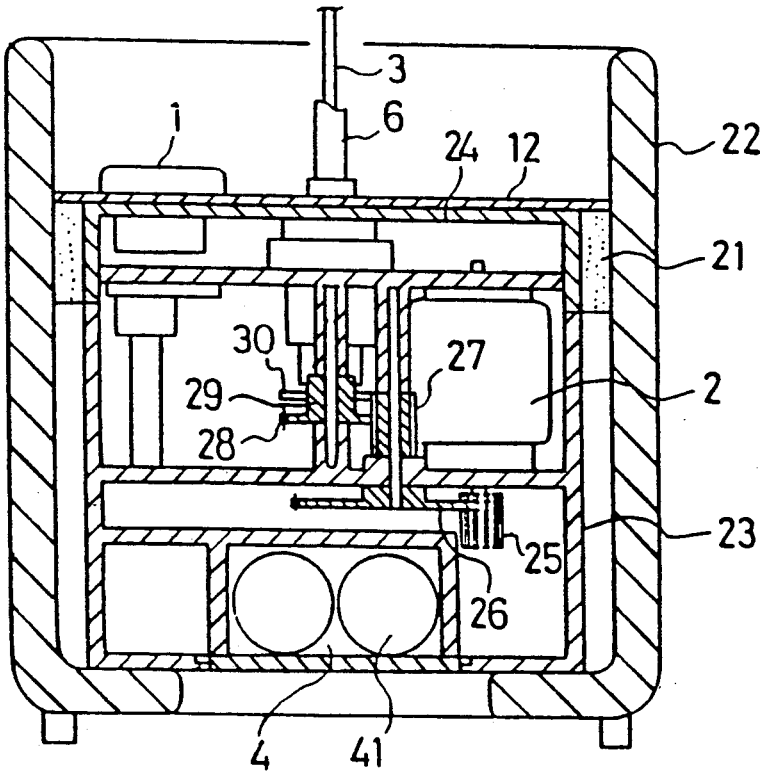
FIG. 9 is a vertical sectional view taken along line V—V of FIG. 6.
Figure 10:
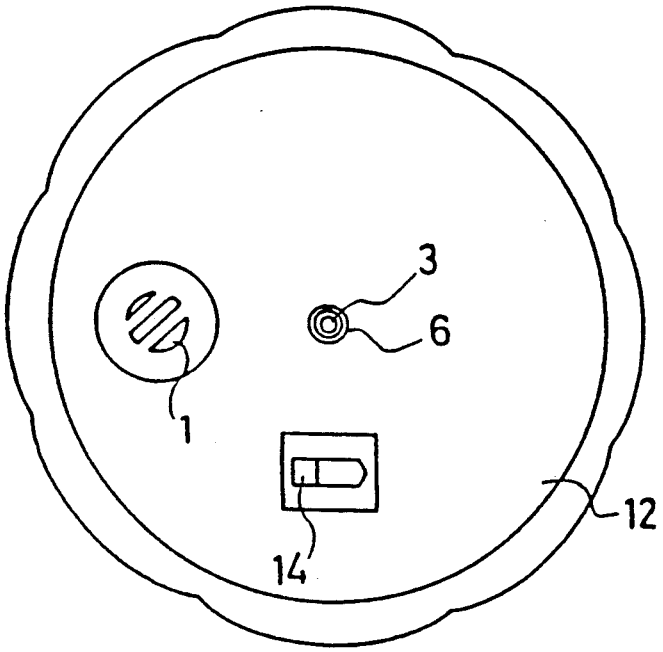
FIG. 10 is a plan view taken along line III—III of FIG. 7.
Figure 13:
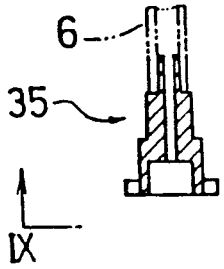
FIG. 13 is a vertical sectional view taken along line VIII—VIII of FIG. 14, which shows a socket.
Figure 14:
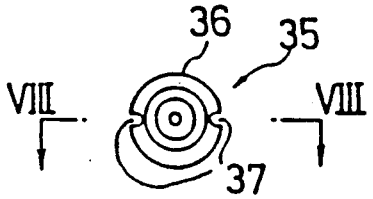
FIG. 14 is a view taken along an arrow IX of FIG. 13.
Figure 15:
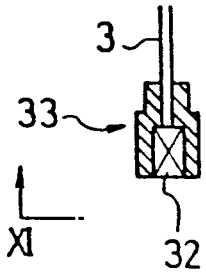
FIG. 15 is a front elevation view in section showing a joint.
Figure 16:
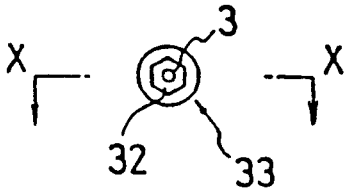
FIG. 16 is a sectional view taken along line X—X of FIG. 15.

A drive mechanism 20, shown in FIGS. 6 to 16 is received through an annular ring cushioning member 21 seen in FIGS. 8 and 9, which spaces the drive mechanism 20 from an outer vessel 22. The mechanism 20 is received in the vessel 22 while being housed in a casing 23 which is closed with a lid 24. The lid 24 has a central aperture with a cylindrical mounting socket 35 extending above the lid 24. An integral sensor housing member 42 extends above the surface of the lid 24. More particularly, the mechanism 20 includes a motor 2 and a drive shaft 31 operatively connected to the motor 2 through gears 25, 26, 27, 28, 29 and 30 in turn, so that drive force of the motor 2 is transmitted to the drive shaft 31. The drive shaft 31 is formed at an upper end thereof into a hexagonal shape in cross section, which is fitted in a hexagonal hole 32 of a joint 33 as shown in FIGS. 15 and 16 for transmission of its torque. Thus, it will be noted that the drive shaft 31 and joint 33 constitutes a coupling together. In the joint 33 is fixed a lower end of a driven element or core 3. The core 3 is rotatably supported in a sleeve 34 of the casing 23. Thus, the core 3 is rotated by the motor 2.

The drive mechanism 20, as shown in FIGS. 7, 13 and 14, also includes a socket 35 mounted on the joint 33 so as to be rotatable relative to the joint 33. The core 3 is rotatably inserted through the socket 35. On an upper end of the socket 35 is securely mounted a hollow element 6. Also, the socket 35 has a bottom portion 36 formed with cutouts 37.

Figure 11:
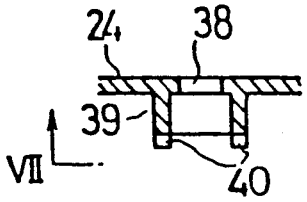
FIG. 11 is a sectional view taken along line VI—VI of FIG. 12, which shows a central portion of a lid.
Figure 12:
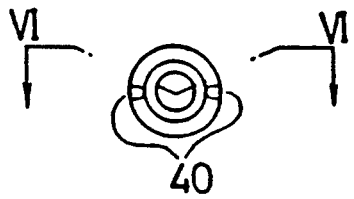
FIG. 12 is a view taken along an arrow VII of FIG. 11.

The lid 24 for covering the casing 23, as shown in FIGS. 11 and 12, is formed at a central portion thereof with a through-hole 38 through which the socket 35 is inserted. The lid 24 is also formed with a cylindrical wall 39 downwardly extending from a lower surface thereof, which is positioned so as to surround the central through-hole 38 while being spaced at a suitable distance from the through-hole 38. The cylindrical wall 39 is provided on a lower end surface thereof with projections 40, which are engagedly fitted in the cutouts 37 to prevent rotation of the socket 35. In the illustrated embodiment, the cutouts 37 and therefore the projections 40 are arranged so as to be spaced at an angular interval of 180° from each other.

Thus, the hollow element or tubular member 6 is fixed with respect to the drive mechanism 20 while ensuring free rotation of the core 3 in the member 6.

Reference numeral 41 designates cells constituting a power supply 4.

Figure 17:
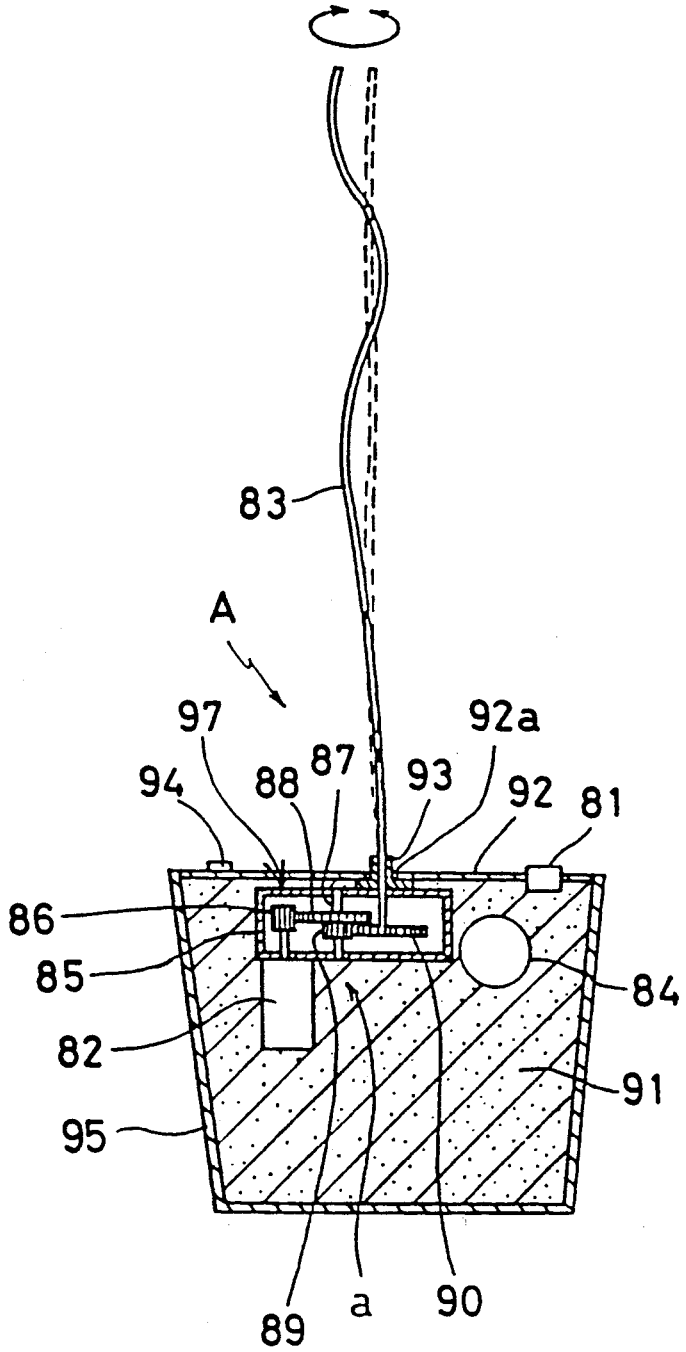
FIG. 17 is a vertical sectional view showing another embodiment of a movable decoration according to the present invention.

FIG. 17 shows another embodiment of a movable decoration according to the present invention, wherein a movable decoration is generally designated by reference numeral A. The movable decoration A of the illustrated embodiment generally includes a drive unit indicated at reference character a and a driven element 83 moved or driven by the drive unit a. In the illustrated embodiment, the drive unit a includes a sensor switch 81, a drive source 82, a drive mechanism 97 actuated by the driving source 2 and a power supply 84. The sensor switch 81 may comprise a sound sensor which is adapted to operate when detecting sound of a predetermined level or more and the drive source 82 may comprise a motor. The power supply 84 may comprise cell means.

The driven element 83, in the illustrated embodiment, comprises a core which takes the form of a wire and is arranged so as to upwardly extend from driving unit a. The core 83 may be formed of a metal material. The driven element or core 83 is operatively connected to the drive mechanism 97 in a manner to be rotatedly moved or driven by the mechanism 97 with rotation of the motor 82. The core 83 may be straight or at least partially bent so that it may generally take a meandering shape. Also, the core 83 may be formed of a deformable or bendable but shape-retaining metal material. Alternatively, it may be formed of a manually undeformable material. The core 83 is rotated while varying its configuration, when it is driven.

The drive mechanism 87 for rotating the driven element or core 83 is received in a casing 85 and includes a gear 88 mounted on a shaft 87 and meshed with a gear 86 mounted on an output shaft of the motor 82, and a gear 90 mounted on a lower end of the core 83 and engaged with a gear 89 mounted on the shaft 87 in parallel with the gear 88. The core is arranged so as to upwardly extend through an upper wall of the casing 85. Thus, the core 83 is rotated with actuation or rotation of the motor 82.

The motor 82 is arranged outside of the casing 85 so as to be positioned on or adjacent to a lower wall of the casing and the power supply 84 is arranged on or adjacent to a side wall of the casing 85 more spaced from the motor 82.

The drive unit a constructed as described above is surrounded with a cushioning member 91 formed of a flexible and expandable material such as, for example, a sponge and received in a vessel 95 which is formed into a frustconical shape. In the embodiment, the cushioning member 91 is substantially filled in the vessel 95. However, it is merely required that the cushioning or elastic member 91 is arranged to cover an outer periphery of the driving unit a.

The vessel 95 is covered at a top thereof with a lid member 92 which is arranged in a manner to be put on the cushioning or elastic member 91, so that a large part of the drive unit a may be closedly kept in the vessel 95. The lid member 92 is formed at a central portion thereof with a through-hole **92*a* through which a mounting sleeve 93 of the drive mechanism 97 is fittedly inserted so as to upwardly extend from the mechanism 97 therethrough. The driven element or core 3 is securely fitted at a lower end thereof on the sleeve 93. Also, the above-described sensor switch 81 is provided on the lid member 92 together with a main switch 94**.

Figure 19:
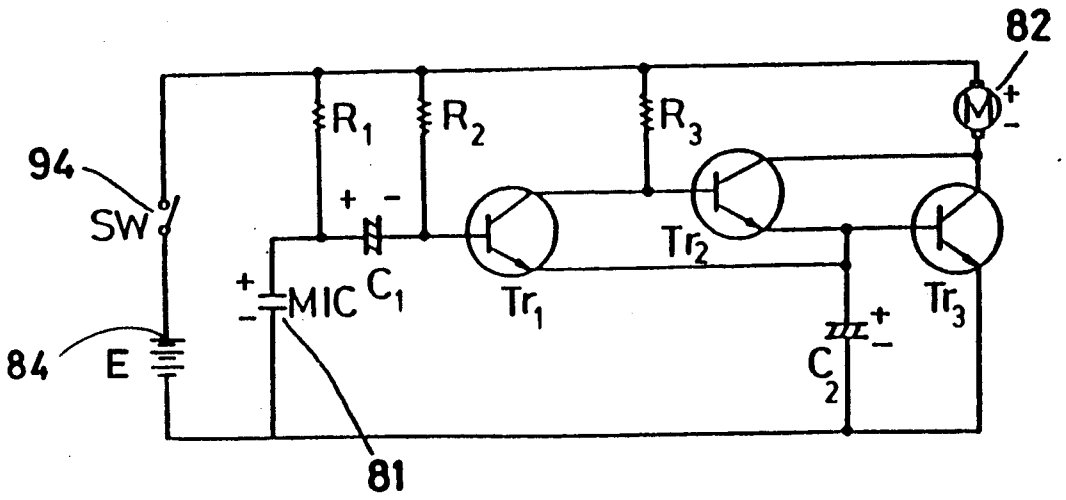
FIG. 19 is a circuit diagram showing an electrical circuit incorporated in the movable decoration shown in FIG. 17.

The parts constituting the drive unit a are electrically connected to one another in such a manner as shown in FIG. 19 which is a circuit diagram. The power supply 84 is connected between the main switch 94 and the drive source or motor 82 and the sensor switch 81 is connected between the main switch 94 and the motor 82, so that when the sensor switch 81 detects sound while closing the main switch 94, the motor 82 is actuated through the power supply 84 for a predetermined period of time.

Alternatively, the circuit for the drive unit a may be constructed in a manner to permit the motor 82 to alternately carry out its actuation and stop when the sensor intermittently or continuously detects subsequent sound.

The remaining part of the illustrated embodiment may be constructed in substantially the same manner as in the above described-embodiment.

Figure 18A:
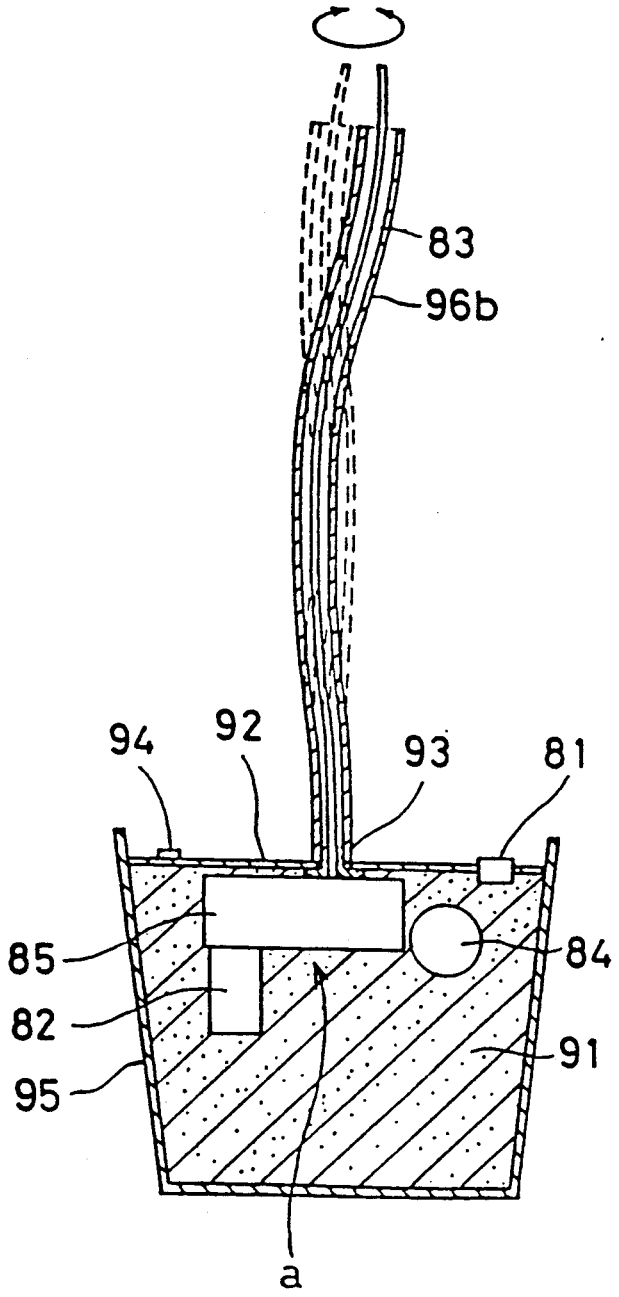
Figure 18B:
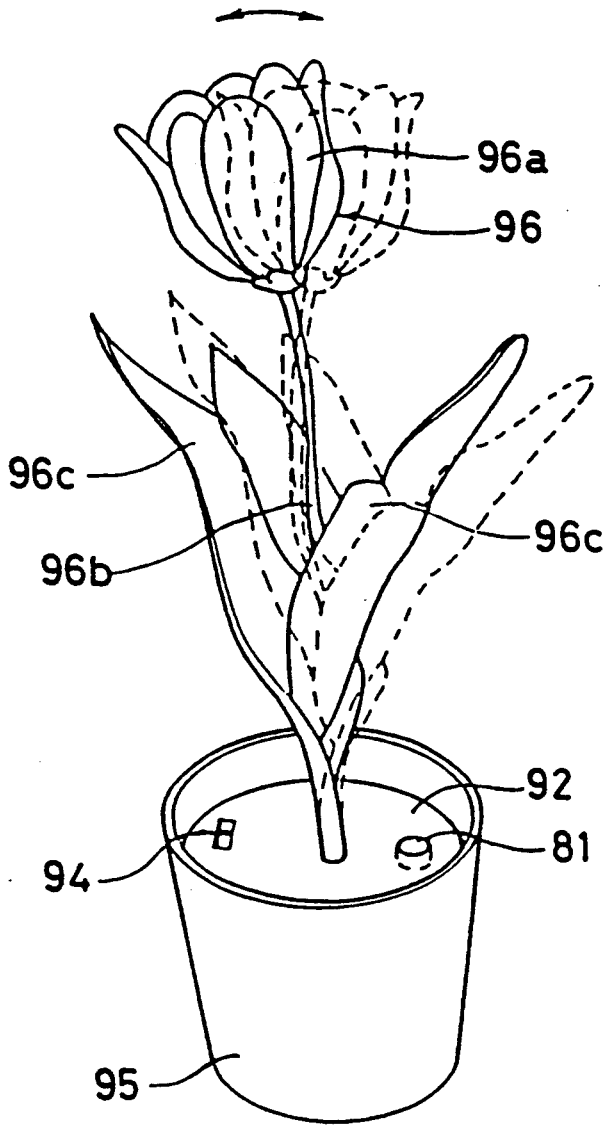

The movable decoration of the illustrated embodiment constructed as described above may be used or applied in the form of an artificial potted plant as shown in FIGS. 18A and 18B. For this purpose, the drive mechanism 97 is received in the vessel 95 formed into a shape like a flowerpot and the driven element or core 83 upwardly exposedly extending from the drive mechanism 97 and vessel 95 is somewhat meanderingly bent and is provided thereon a hollow element 96 constituting a decorative element or artificial flower, which is formed in imitation of a tulip. The decorative element or artificial flower 96 comprises a stalk **96*b* formed of a tubular material and loosely fitted on the core 83, and a flower body 96*a* and leaves 96*c* integrally mounted on the stalk 96*b*. In the embodiment, only the stalk is formed into a hollow shape. The flower 16 may be integrally formed of a flexible synthetic material. In the example of FIG. 18, the stalk 16*b* loosely fitted on the core 83 is securely fitted at a lower end thereof on the mounting sleeve 93 of the drive mechanism 97, so that the core 3 may be freely moved or rotated in the flower 16 and the flower 16 may be meanderingly moved depending on and separate from movement or rotation of the core 83**.

In the example of FIGS. 18A and 18B constructed as described above, when the main switch 93 is turned on and the sensor switch 81 detects sound of a predetermined level or more, the motor 82 is actuated. This causes the drive mechanism 97 to be actuated because the drive mechanism 97 is operatively connected to the motor 82 through gears 86, 88, 89 and 90, resulting in the core 83 being rotated in the stalk **96*b***.

When the meanderingly bent core 83 is thus rotated, the stalk **96*b* is meanderingly moved depending on and separate from rotation of the core 83, so that the flower 16** is varied in configuration to lead to unexpected variation and motion in appearance and configuration, resulting in a viewer taking interest and exhibit imaginative power.

Figure 20B:
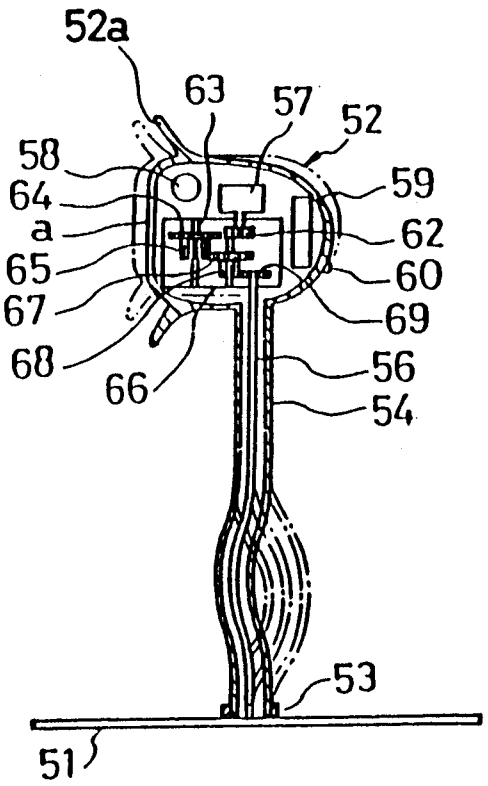
FIG. 20B is a vertical sectional view of the movable decoration shown in FIG. 20A.
Figure 20A:
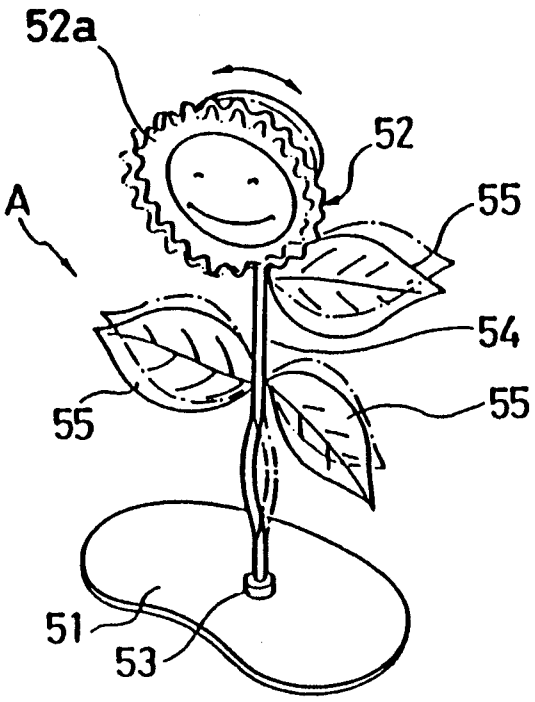
FIG. 20A is a perspective view showing a further embodiment of a movable decoration according to the present invention.

FIGS. 20A and 20B show a further embodiment of a movable decoration according to the present invention, wherein a movable decoration is generally indicated at reference character A.

The movable decoration A of the embodiment is in the form of an artificial plant, which includes a base 51 and a flower 52. The base 51 is made of a synthetic resin material into a plate of a substantially elliptic shape and is formed at a central portion of an upper surface thereof with an upwardly projecting sleeve 53.

The flower 52 is made in imitation of a sunflower. The flower 52 includes a hollow stalk 54 which is made of a tubular material and fittedly mounted at a lower end thereof on the sleeve 53. In the tubular stalk 52 is loosely fitted a driven element or core as described below. The flower 52 also includes a hollow flower body **52*a* mounted on an upper end of the stalk 54 so as to be communicated with the stalk 54. The stalk 54 and flower body 52*a* may be integrally formed of a flexible and/or deformable synthetic resin material. On the stalk 54 is wound a fabric tape (not shown) to reinforce it. The flower 52 also includes leaves 55 attached to the stalk 54** by suitable means.

In the stalk 54 is loosely fitted a driven element or core 56 which takes the form of a wire and is at least partially bent or deformed so that it may have a generally meandering shape. The core 56, as shown in FIG. 20B, is connected to a drive unit a arranged in the flower body **52*a* and including a motor 57, resulting in being rotated by the drive unit a. The drive unit a also includes a sensor switch 58 adapted to operate upon detection of sound of a predetermined level or more, a power supply 59 and a main switch 60, each of which is received in the flower body 52*a*. The main switch 60** is adapted to be externally operated.

Figure 21:
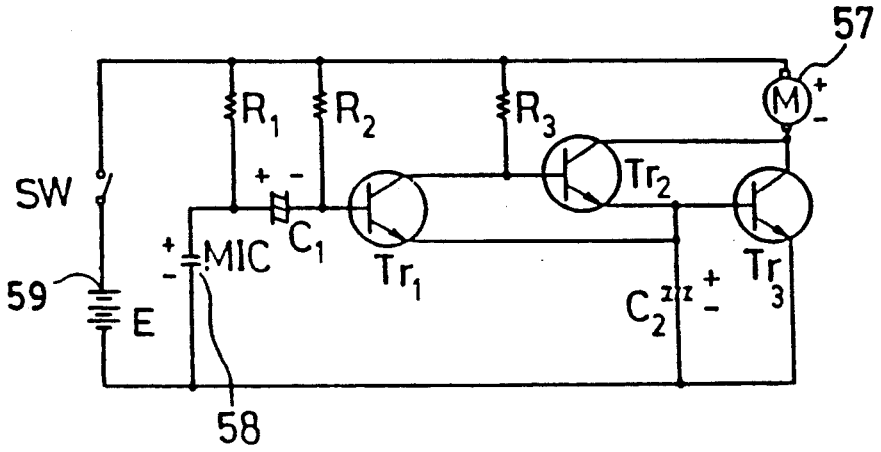
FIG. 21 is a circuit diagram showing an electrical circuit incorporated in the movable decoration shown in FIG. 20A.

The above-described parts constituting the drive unit a are electrically connected to one another in such a manner as shown in FIG. 21 which is a circuit diagram. The power supply 59 is connected between the main switch 60 and the drive source or motor 57 and the sensor switch 58 is connected between the main switch 60 and the motor 57, so that when the sensor witch detects 58 sound of a predetermined level or more while closing the main switch 60, the motor 57 is actuated through the power supply 59 for a predetermined period of time.

Alternatively, the circuit for the drive unit a may be constructed in a manner to permit the motor driving circuit to alternately turn on and turn off the motor when the sensor intermittently or continuously detects subsequent sound.

The drive unit a received in the flower body 52*a* for rotating the driven element or core 83 includes a gear 64 mounted on a shaft 63 and meshed with a gear 62 mounted on an output shaft of the motor 57, and a gear 67 mounted on a shaft 66 and engaged with a gear 65 mounted on the shaft 63 in parallel with the gear 64, and a gear 68 mounted on the shaft 66 in parallel with the gear 67. The gear 68 is engaged with a gear 69 mounted on an upper end of the core 56. Thus, the core 56 is rotated with actuation or rotation of the motor 57.

The remaining part of the illustrated embodiment may be constructed in substantially the same manner as in the above described-embodiment.

In the embodiment of FIGS. 20A and 20B constructed as described above, when the main switch 60 is turned on and the sensor switch 58 detects sound of a predetermined level or more, the motor 57 is actuated. This causes the drive unit a to be actuated because the gear 62 mounted on the output shaft of the motor 57 is engaged with the gear 64 of the drive unit a, resulting in the core 56 being rotated in the stalk 96*b* formed of a flexible and/or deformable material.

When the meanderingly bent core 56 is thus rotated, the stalk 54 is meanderingly moved together with the flower body 52*a* depending on and separate from rotation of the core 83, so that the movable decoration A is varied in configuration and appearance to lead to unexpected variation in appearance and configuration and unique motion.

Also, as described above, the drive unit a for rotating the core 56 in the stalk 54 is received in the flower body 52*a* provided on the upper end of the stalk 54 so that it may not be visually observed from the outside, to thereby cause a viewer to take much interest and exhibit lots of imaginative power in connection with variation and motion of the decoration A.

Further, the construction of the illustrated embodiment that the sensor switch 58 is incorporated in the drive unit a causes a viewer to be impressed as if the movable decoration were alive and there were any communication between a viewer and the movable decoration, because it can suddenly move in response to viewer's hand clapping or the like.

Figure 22:
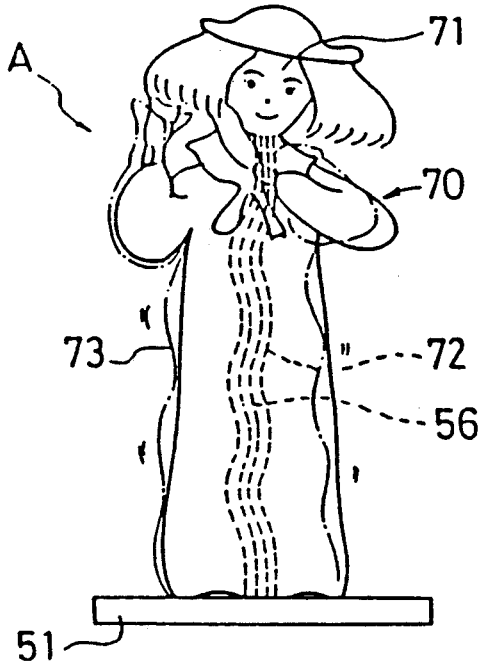
FIG. 22 is a front elevation view showing still another embodiment of a movable decoration according to the present invention.

FIG. 22 shows still another embodiment of a movable decoration according to the present invention, wherein a movable decoration generally indicated at reference character A is made in imitation of a doll, which is constituted by a hollow element 70. The doll or hollow element 70 includes a head 71, a base 51 and a hollow or tubular member 72 formed of a flexible and/or deformable synthetic resin material for connecting the head 71 and the base 51 to each other therethrough. Also, the doll includes a dress 73 which is arranged so as to surround the tubular member 72 and from which a pair of arms extend. In the tubular member 72 is loosely fitted a driven element or core 56 of which at least a part is bent so that it may generally take a meandering form. The core 56 is operatively connected at an upper end thereof to a drive unit (not shown) received in the head 71, resulting in being rotated by the drive unit.

The remaining part of the embodiment of FIG. 22 including the drive unit may be constructed in substantially the same manner as that shown in FIGS. 20A and 20B.

In the embodiment of FIG. 22 constructed as described above, when the core 56 is rotated by the drive unit (not shown), the tubular member 72 is meanderingly moved depending on and separate from rotation of the core 56, to thereby cause the dress 73 of the doll 70 to move. This results in a viewer being impressed as if the movable decoration or doll 70 were dancing.

Also, in the embodiment of FIG. 22, the lower portion of the tubular member 72 of the hollow element or doll 70 may be freely used for setting of the decoration. For this purpose, for example, the embodiment may be so constructed that the core 56 downwardly extends at a lower end thereof from the tubular member 72 and is insertedly fixed in a perforated support (not shown) in the form of a plate, a cylinder or the like in a detachable manner. Such construction permits a plurality of the movable decorations to be detachably set together on the support, resulting in a user enjoying a variation in layout of the movable decoration.

Figure 23A:
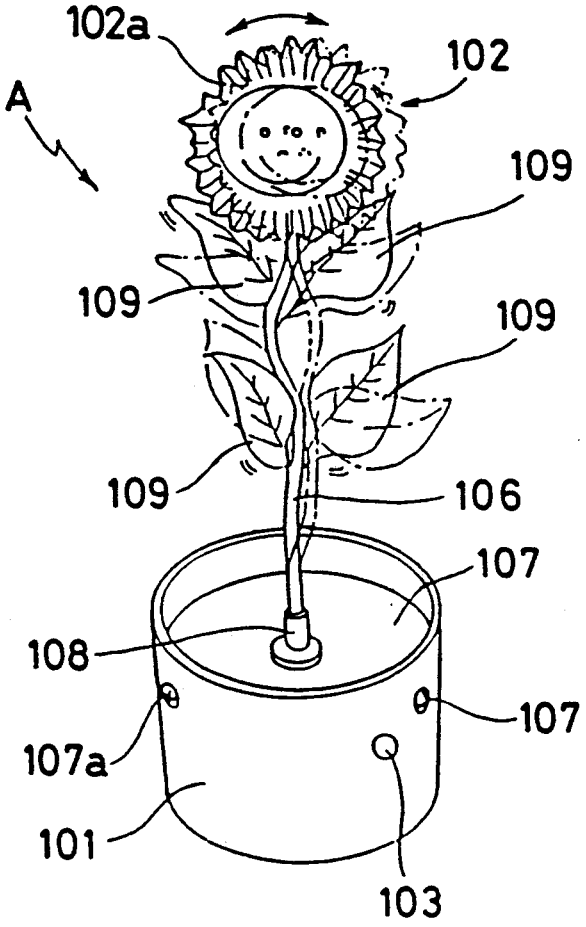
FIG. 23A is a perspective view showing still a further embodiment of a movable decoration according to the present invention.
Figure 23B:
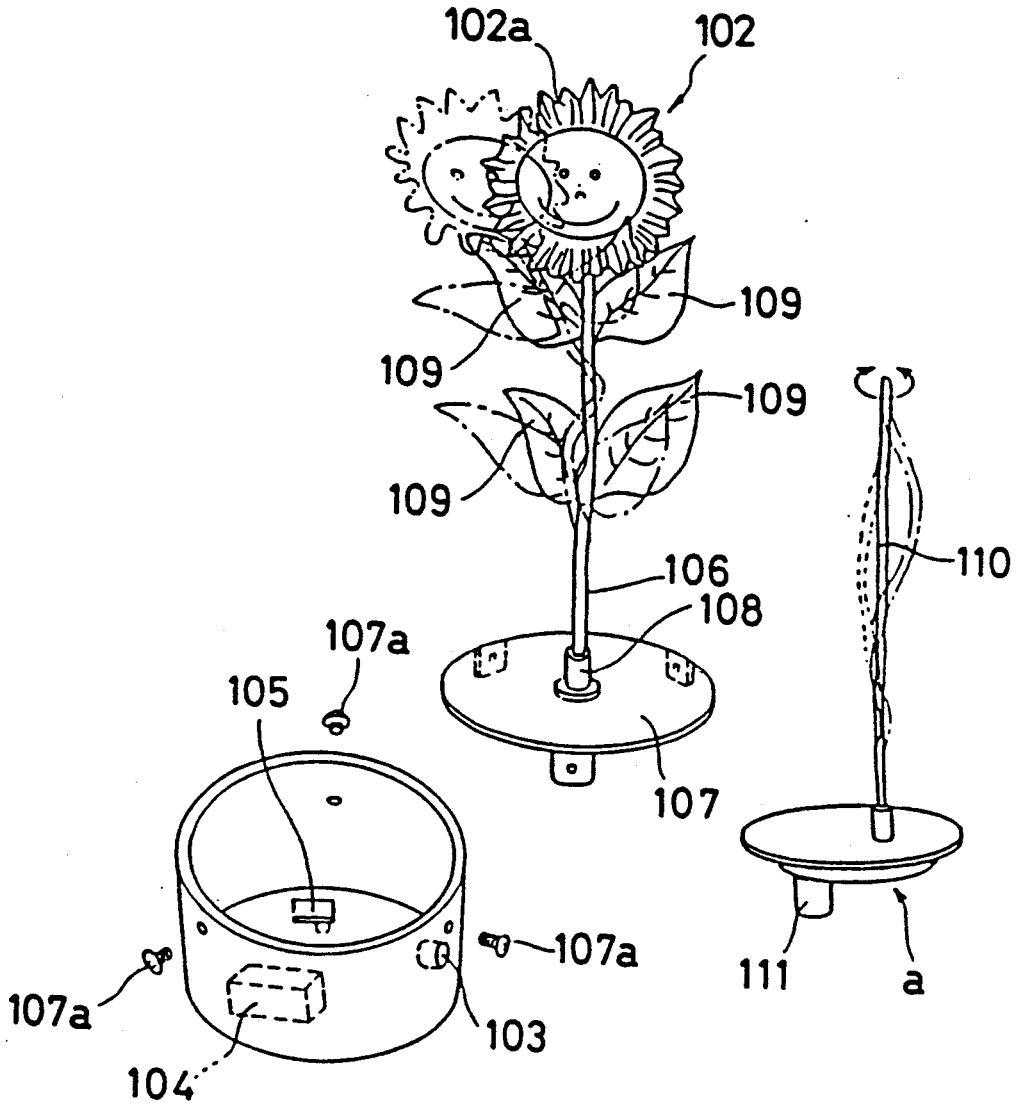
FIG. 23B is an exploded perspective view of the movable decoration shown in FIG. 23A.

FIGS. 23A and 23B show still a further embodiment of a movable decoration according to the present invention, wherein a movable decoration is generally designated by reference character A. The movable decoration A is made in imitation of an artificial potted plant which is generally constituted by a flowerpot 101 and a flower 102 planted in the pot 101. The flowerpot 101 is formed of a synthetic resin material, in which a switch sensor 103 adapted to operate upon detection of sound of a predetermined level or more, a power supply 104 and a main switch 105 which constitute a part of a drive unit a (FIG. 24) are received. The sensor switch 103 is arranged in a manner to be exposed at a front portion thereof from a side wall of the flowerpot 101 and the main switch 105 is arranged on the flowerpot 101 so that it may be externally operated.

The flower or hollow element 102 is formed in imitation of a sunflower and includes a stalk 106, a flower body 102*a* supported on an upper end of the stalk 106 and leaves 109 mounted on the stalk 106. The stalk 106 is formed of a flexible and/or deformable tubular material and fittedly mounted at a lower end thereof on a mounting sleeve 108 which is provided at a central portion of an upper surface of a lid member 107 securely fitted in an upper portion of the flowerpot 101 by means of screws 107*a* to cover the flowerpot 101. Thus, in the embodiment, only the stalk 106 of the flower or hollow element 102 is formed into a hollow shape. In the stalk 106 is loosely fitted a driven element or core 110 so that it may be freely rotated in the stalk 106 as described below. The flower body 102*a* and stalk 106 are formed of a flexible synthetic resin material and the stalk 106 has a fabric tape wound on an outer periphery thereof for reinforcement.

Figure 24:
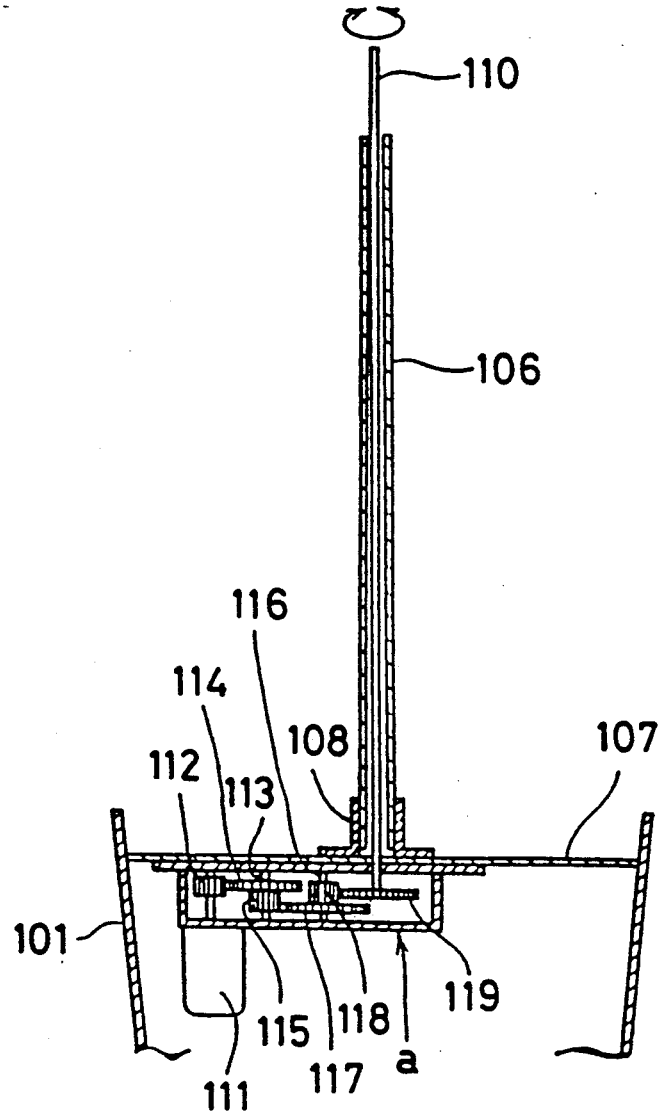
FIG. 24 is a vertical sectional view showing an essential part of the movable decoration of FIG. 23A.
Figure 25:
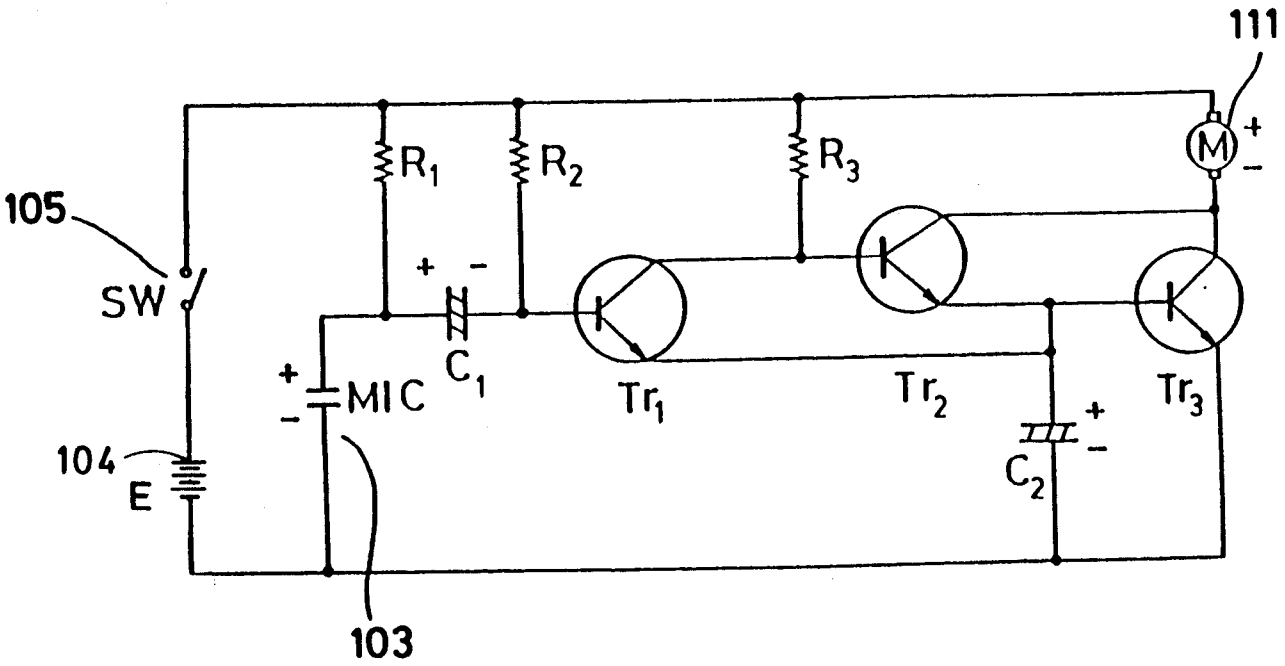
FIG. 25 is a circuit diagram showing an electrical circuit incorporated in the movable decoration shown in FIG. 23A.

As briefly described above, in the stalk 106 is loosely fitted the driven element or core 110 made of a metal material, which is in the form of a wire. The core 110 is at least partially bent or curved so that it may generally take a meandering form. For this purpose, the core 110 may be formed of a flexible and shape-retaining metal material. The core 110 is operatively connected to the drive unit a possessing a motor as a drive source 111 as shown in FIG. 24, so that it may be rotated depending on actuation of the drive unit. The sensor switch 103 described above, as shown in FIG. 25, is connected to a drive circuit of the motor 111. Thus, the motor 111 is adapted to continue its actuation for a predetermined period of time when the sensor switch 103 detects sound of a predetermined level or more.

Alternatively, the circuit for the drive unit may be constructed in a manner to permit the motor to alternately carry out its actuation and stop when the sensor intermittently or continuously detects subsequent sound.

Also, in the illustrated embodiment, the sensor switch 103 is adapted to detect sound. However, it may be constructed so as to detect light, heat, smell, gas or the like other than sound.

A main part of the drive unit a is arranged on a lower surface of the lid member 107 and the drive unit includes, in addition to the above, a gear assembly comprising a gear 114 mounted on a shaft 113 and engaged with a gear 112 mounted on an output shaft of the motor 111, a gear 117 mounted on a shaft 116 and engaged with a gear 115 mounted on the shaft 113 in parallel with the gear 114, and a gear 119 mounted on a lower end of the core 110 and engaged with a gear 118 mounted on the shaft 116 in parallel with the gear 117. Thus, the core 110 is rotated through the so-constructed gear assembly with actuation of the motor 111.

In the embodiment of FIGS. 23A and 23B constructed as described above, when the main switch 105 is turned on and the sensor switch 103 detects sound of a predetermined level or more, the motor 111 is actuated. This causes the drive unit a to be actuated because the gear 112 mounted on the output shaft of the motor 111 is engaged with the gear 114 of the gear assembly of the drive unit a, so that the gear assembly may be actuated. This results in the core 106 being rotated in the stalk 106 formed of a flexible and/or deformable tubular material.

When the meanderingly bent core 110 is thus rotated, the stalk 106 is meanderingly moved together with the flower body 52*a* depending on and separate from rotation of the core 110, so that the movable decoration A is varied in configuration and appearance to lead to unexpected variation in appearance and configuration and unique motion. Also, the construction of the illustrated embodiment causes a viewer to be impressed as if the movable decoration were alive.

Further, use of the sensor switch in the embodiment results in a viewer being impressed as if there were any communication between the viewer and the movable decoration, because it can move in response to viewer's hand clapping or the like.

Also, the illustrated embodiment is capable of exhibiting various functions such as information of a visitor, warning of gas leakage and the like other than a knick-knack.

As can be seen from the foregoing, the movable decoration of the present invention is moved to exhibit unexpected motion or variation in configuration and appearance while maintaining a normal ornamental function in a stationary state, resulting in a viewer taking much interest and exhibiting lots of imaginative power.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A sound activated toy assembly comprising:

a casing member having an upper horizontal lid member including a central aperture and an integral sensor housing extending upward from the lid member;

a mounting member operatively associated with the central aperture and extending upward from the lid member;

an electric motor means provided in the casing member;

a transmission assembly connected to the electric motor means for providing movement including an output member responsive to the activation of the motor means;

an elongated core member extending through the central aperture and the mounting member and connected to the output member, the core member cantilevered vertically above the casing member, the core member has a nonlinear configuration and, when moved by the electric motor means, portions of the core member travel on paths about a longitudinal axis extending upward from the output member to create a wobbling visual effect;

a flexible elongated hollow member extends over the core member and is dimensioned to permit relative rotational interior movement of the core member while transmitting the wobbling visual effect to an observer, the flexible elongated hollow member being fixed to the mounting member at one end so that it does not move in complete unison with the core member, and means, including a sound sensor mounted in the sensor housing, responsive to predetermined sound characteristics, for activating the motor means.

2. The toy assembly of claim 1 wherein the core member is a metal wire bent to extend at certain positions off of the longitudinal axis.

3. The toy assembly of claim 1 further including a plurality of simulated leaves attached to the hollow member and a simulated musical instrument attached to at least one leaf.

4. The decorative assembly of claim 3 further including an outer housing surrounding the casing member and simulating a plant pot and resilient means positioned between the casing member and an interior surface of the outer housing plant pot.

5. The decorative assembly of claim 4 wherein the resilient means includes an annular ring of resilient material.

6. A sound activated toy assembly comprising:

a casing member;

motor means provided in the casing member;

a transmission assembly connected to the motor means for providing movement including an output member responsive to the activation of the motor means;

a drive member connected to the output member;

a flexible member connected to the output member for movement;

means, within the casing member, responsive to predetermined sound characteristics, for activating the motor means;

an outer housing having an inner diameter larger than the casing member and surrounding the casing member, and resilient means positioned between and releasably contacting the inner diameter of the outer housing and the casing member for spacing the casing member from the outer housing.

7. A mobile toy assembly comprising:

a casing member;

motor means provided in the casing member;

a transmission assembly connected to the motor means for providing movement including an output member positioned adjacent an upper portion of the casing member and responsive to the activation of the motor means;

an elongated core member connected to the output member and cantilevered vertically above the casing member, the core member has a nonlinear configuration and, when moved by the motor means, portions of the core member travel on paths about a longitudinal axis extending from the output member to create a wobbling visual effect;

a flexible elongated hollow member extends over the core member and is dimensioned to permit relative interior movement of the core member while transmitting the wobbling visual effect to an observer, the flexible elongated hollow member being fixed to the casing member at one end so that it does not move in complete unison with the core member, and means responsive to predetermined sound characteristics to activate the motor means for a predetermined time period, whereby the toy assembly can appear stationary for a visual effect on an observer and can further exhibit a wobbling movement in response to the stimulus of the predetermined sound characteristic for a further pleasing effect on the observer.

8. The decorative assembly of claim 7 wherein the core member is a metal wire bent to extend at certain positions off of the longitudinal axis.

9. The decorative assembly of claim 8 further including an outer housing member and a resilient means positioning the casing member interiorly within the outer housing member.

10. A mobile toy assembly comprising:

a casing member;

motor means provided in the casing member;

a transmission assembly connected to the motor means for providing movement including an output member responsive to the activation of the motor means;

an elongated core member connected to the output member and cantilevered vertically above the casing member, the core member has a nonlinear configuration and, when moved by the motor means, portions of the core member travel on paths about a longitudinal axis extending from the output member to create a wobbling visual effect;

a flexible elongated hollow member extends over the core member and is dimensioned to permit relative rotational interior movement of the core member while transmitting the wobbling visual effect to an observer, the flexible elongated hollow member being fixed to the casing member at one end so that it does not move in complete unison with the core member;

means, responsive to predetermined sound characteristics, for activating the motor means, and an upper plant face assembly attached at an end of the elongated hollow member whereby the toy assembly can appear stationary for a visual effect on an observer and can further exhibit a wobbling movement of the elongated hollow member and plant face assembly in response to the stimulus of the predetermined sound characteristic for a further pleasing effect on the observer.

11. The mobile toy assembly of claim 10 wherein the core member is a metal wire bent to extend at certain positions off of the longitudinal axis.

12. The mobile toy assembly of claim 10 further including an outer housing and resilient means positioned between the casing member and an interior surface of the outer housing.

13. The mobile toy assembly of claim 10 wherein the casing member includes an upper flat horizontal lid member including a central aperture and a mounting member is operatively associated with the central aperture, whereby the elongated core member extends through the lid member aperture and the mounting member and the hollow member is fixedly attached to the mounting member.

* * * * *